US009657994B2

(12) United States Patent
Mossmann

(10) Patent No.: US 9,657,994 B2
(45) Date of Patent: May 23, 2017

(54) ARC FURNACE

(71) Applicant: PRIMETALS TECHNOLOGIES AUSTRIA GMBH, Linz (AT)

(72) Inventor: Björn Mossmann, Offenburg (DE)

(73) Assignee: PRIMETALS TECHNOLOGIES AUSTRIA GMBH (AT)

( * ) Notice: Subject to any disclaimer, the term of this patent is extended or adjusted under 35 U.S.C. 154(b) by 62 days.

(21) Appl. No.: 14/413,639

(22) PCT Filed: Jun. 12, 2013

(86) PCT No.: PCT/EP2013/062089
§ 371 (c)(1),
(2) Date: Jan. 8, 2015

(87) PCT Pub. No.: WO2014/009085
PCT Pub. Date: Jan. 16, 2014

(65) Prior Publication Data

US 2015/0139266 A1 May 21, 2015

(30) Foreign Application Priority Data

Jul. 11, 2012 (EP) ..... 12175917

(51) Int. Cl.
*F27D 1/02* (2006.01)
*F27D 1/00* (2006.01)
(Continued)

(52) U.S. Cl.
CPC ..... *F27D 11/08* (2013.01); *F27B 3/06* (2013.01); *F27B 3/065* (2013.01); *F27B 14/02* (2013.01);
(Continued)

(58) Field of Classification Search
CPC .... F27B 3/06; F27B 3/065; F27B 3/16; F27B 3/183; F27B 3/085; F27B 3/186;
(Continued)

(56) References Cited

U.S. PATENT DOCUMENTS 2,313,837 A * 3/1943 Nissim ..... F27B 3/16 373/73
4,123,617 A * 10/1978 Wynne ..... F27D 11/08 373/84
(Continued)

FOREIGN PATENT DOCUMENTS

DE 1 067 984 10/1959
EP 0 203 339 A2 12/1986
EP 0 385 434 A2 9/1990

OTHER PUBLICATIONS

International Search Report dated Jul. 10, 2014 issued in corresponding International patent application No. PCT/EP2013/062089.
(Continued)

*Primary Examiner* — Hung D Nguyen
(74) *Attorney, Agent, or Firm* — Ostrolenk Faber LLP

(57) ABSTRACT

An arc furnace having a furnace vessel for melting steel, a cover for closing the furnace vessel and a pivot unit with which the cover can be moved away from the furnace vessel in which the furnace vessel is mounted so as to be movable in the vertical direction relative to the pivot unit, and the pivot unit has a holder for releasably fixing the cover in the vertical direction.

8 Claims, 2 Drawing Sheets

(51) Int. Cl.

| | |
|---|---|
| ***F27D 11/08*** | (2006.01) |
| ***F27B 3/06*** | (2006.01) |
| ***F27D 1/18*** | (2006.01) |
| ***F27B 14/02*** | (2006.01) |
| ***F27B 14/06*** | (2006.01) |
| ***F27B 14/12*** | (2006.01) |
| *F27B 14/08* | (2006.01) |

(52) U.S. Cl.
CPC ..... *F27B 14/06* (2013.01); *F27B 14/12* (2013.01); *F27D 1/1816* (2013.01); *F27B 2014/0831* (2013.01)

(58) Field of Classification Search
CPC ..... F27B 3/10; F27B 3/12; F27B 3/19; F27B 14/02; F27B 14/06; F27B 14/12; F27B 2014/0831; F27D 1/1816; F27D 11/08
USPC ..... 373/60, 62, 71, 72, 73, 74, 83, 84
See application file for complete search history.

(56) References Cited

U.S. PATENT DOCUMENTS

| | | | | |
|---|---|---|---|---|
| 4,437,187 | A * | 3/1984 | Riegler | F27B 3/16 373/73 |
| 4,841,542 | A * | 6/1989 | Zajicek | C21C 5/5211 373/73 |
| 5,153,894 | A * | 10/1992 | Ehle | C21C 5/5211 373/83 |
| 2013/0208755 | A1* | 8/2013 | Heinemann | C21C 5/527 373/73 |

OTHER PUBLICATIONS

Written Opinion dated Jul. 10, 2014 issued in corresponding International patent application No. PCT/EP2013/062089.

* cited by examiner

ARC FURNACE

CROSS-REFERENCE TO RELATED APPLICATIONS

The present application is a 35 U.S.C. §§371 national phase conversion of PCT/EP2013/062089, filed Jun. 12, 2013, which claims priority of European Application No. 12175917.9, filed Jul. 11, 2012. The contents of both applications are incorporated by reference herein. The PCT International Application was published in the German language.

FIELD OF THE INVENTION

The invention relates to an arc furnace.

BACKGROUND

Arc furnaces are used for the reprocessing of steel scrap, the steel scrap being heated and finally melted by means of an electrode and a burning arc. Such an arc furnace comprises a furnace vessel for melting the steel and a cover for closing the furnace vessel during the melting process. In order to charge the furnace with scrap, and maintain the furnace, it is necessary to open the furnace vessel and therefore swivel the cover open. To this end, the cover is connected via a pivot cylinder to a swivel unit, which is also referred to as a portal. The cover is first raised by the pivot cylinder, thereby releasing it from the furnace vessel. It can then be swiveled away laterally from the furnace vessel by means of the swivel unit.

In order to empty the liquid steel from the furnace vessel, the furnace vessel is tilted about an axis which is perpendicular to the longitudinal axis of the furnace. For this purpose, the furnace vessel is mounted in a cradle which has a rolling contact path for this tilting movement. During such a tilting movement, the swivel unit with the cover is also tilted.

SUMMARY OF THE INVENTION

The object of the present invention is to specify an arc furnace in which the opening operation is simplified.

The arc furnace according to the invention has a furnace vessel for melting steel, a cover for closing the furnace vessel, and a swivel unit by means of which the cover can be moved away from the furnace vessel. Moreover, the furnace vessel is so mounted as to be movable in a vertical direction relative to the swivel unit. Furthermore, the swivel unit has a holder for releasably fixing the cover in a vertical direction.

The arc furnace according to the invention therefore differs from an arc furnace according to the prior art in that the furnace vessel is so mounted as to be movable in a vertical direction relative to the swivel unit, and the cover is releasably fixed to a holder of the swivel unit and is therefore not permanently connected to the swivel unit.

In a position in which the melting operation takes place, the cover is arranged above the furnace vessel such that the furnace vessel is closed. The cover does not engage with the swivel unit in this case, and is therefore not connected to it. During the melting operation, the swivel unit can therefore move freely and without the cover. It is therefore easier to replenish the electrodes arranged at the swivel unit.

In order to release the cover of the arc furnace from the furnace vessel, the cover is first hung onto the holder of the swivel unit by moving the furnace vessel downwards in a vertical direction relative to the stationary swivel unit, such that the cover is fixed in a vertical direction. This is followed by a further downward movement of the furnace vessel in a vertical direction, such that the cover is released from the furnace vessel and can subsequently be moved away from the furnace vessel.

By virtue of the arc furnace configuration according to the invention, in particular by virtue of the furnace vessel and cover being so mounted as to be movable in a vertical direction, it is therefore possible to dispense with the pivot cylinder. This means that fewer components are needed and costs associated with processing the cover lifting mechanism are saved.

Furthermore, as a result of the stationary swivel unit, the cover and the swivel unit are not tilted in conjunction with the furnace vessel during the emptying of the furnace vessel and the associated tilting movement thereof, and therefore tapping can be performed at the same time as energy is input to the furnace and/or the electrodes, thereby increasing the overall duration of the energy input and increasing productivity. This is possible because electrode management tasks can be performed while the cover remains in a horizontal position.

In a preferred embodiment of the invention, the furnace vessel is mounted in a cradle which can be moved in a vertical direction. Such a cradle can preferably be moved by means of hydraulic cylinders. Consequently, the cradle and the furnace vessel mounted therein can be moved downwards or upwards in a vertical direction by actuating the hydraulic cylinders.

If the cradle has a plurality of hydraulic cylinders which can be activated separately, these can be moved not only upwards and downwards in a vertical direction but also tilted for the purpose of emptying the furnace vessel.

In a further preferred embodiment of the invention, when closing the furnace vessel, the cover is supported by struts which are arranged on the cradle. In the case of a downward vertical movement of the cradle with the struts, and consequently the furnace vessel also, the cover is fixed onto the holder of the swivel unit and is therefore also released from the struts.

In a further preferred embodiment of the invention, the cover can be moved away from the furnace vessel by means of the swivel unit, employing a rotational movement about an axis which extends in a vertical direction. The cover is therefore moved away from the furnace vessel laterally in a horizontal direction.

The above-described properties, features and advantages of this invention, and the means by which these are realized, become clearer and easier to understand in the context of the following description of the exemplary embodiments, which are explained in greater detail in conjunction with the drawings.

BRIEF DESCRIPTION OF THE FIGURES

For a further description of the invention, reference is made to the exemplary embodiments in the drawings, representing a schematic diagram in each case, in which.

DETAILED DESCRIPTION

Figure 1:
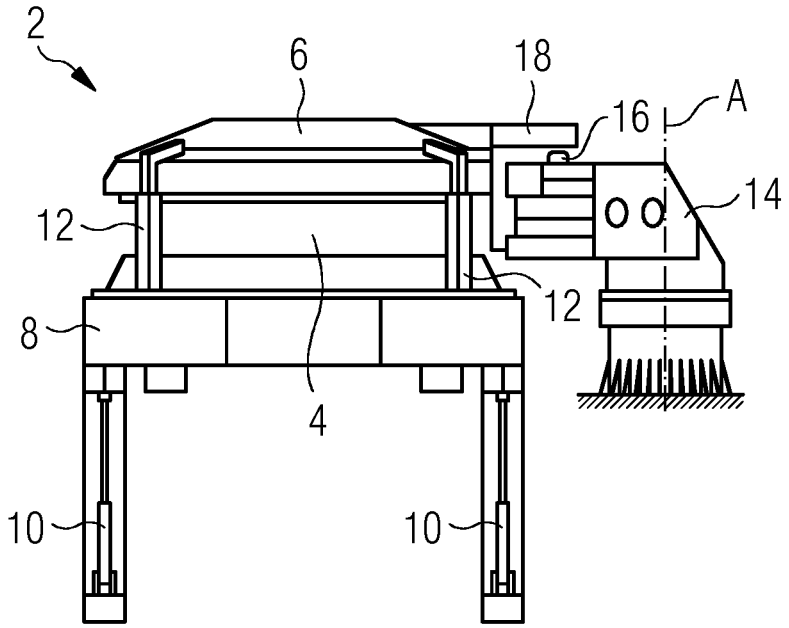
FIG. 1 shows an arc furnace with a cover in a position during the melting operation.

FIG. 1 illustrates an arc furnace 2 having a furnace vessel 4 for melting steel and a cover 6 for closing the furnace vessel.

The cover 6 in this case is located in a position in which it closes the furnace vessel 4, as is the case during the melting operation for steel.

The furnace vessel 4 is mounted in a cradle 8, which has a plurality of hydraulic cylinders 10 that can be activated separately. The hydraulic cylinders 10 are illustrated in their extended position in FIG. 1. By virtue of the travel of the hydraulic cylinders 10, the cradle 8 can therefore be moved downwards or upwards in a vertical direction, whereby the furnace vessel 4 can likewise be moved in a corresponding direction. A plurality of struts 12 are also arranged on the cradle 8, and support the cover 6 of the arc furnace 2 in the closed state of the furnace vessel 4, as illustrated in FIG. 1. In addition to the cradle 8 and the furnace vessel 4, provision is also made for a stationary swivel unit 14, also referred to as a portal, which is so mounted as to be rotatable solely about its axis A. The swivel unit 14 is used to move the cover 6 away from the furnace vessel 4. The swivel unit 14 also comprises a holder 16, in which the cover can be fixed in a vertical direction. In the exemplary embodiment illustrated here, the holder 16 is composed of a bearing surface and a peg with which a correspondingly shaped connection unit 18 of the cover can engage.

In order to open the furnace vessel 4, furnace vessel 4 is moved downwards in a vertical direction relative to the swivel unit 14, which is stationary in a vertical direction. This is achieved by moving the hydraulic cylinders 10 into a retracted state and thereby moving the cradle 8 downwards in a vertical direction, i.e. lowering it. As a result of the downward movement, the furnace vessel 4 and the cover 6 are also moved downwards with the cradle 8. The cover 6 continues to move downwards in this way until the connection element 18 engages with the holder 16 of the swivel unit 14, and the cover 6 is thus hung onto the swivel unit 14. The connection element 18 therefore comes to rest on the holder surface in this case, and any further movement of the cover 6 in a vertical direction is consequently no longer possible since the cover 6 is then fixed in a vertical direction. The cover 6 is also fixed in a horizontal direction by means of the peg, such that only a rotational movement of the cover 6 is possible.

Consequently, the cover 6 does not accompany the cradle 8 and furnace vessel 4 as they move further downwards in a vertical direction relative to the swivel unit 14. Instead, the cover 6 remains fixed onto the holder 16 of the swivel unit 14. The cover 6 is released from the furnace vessel 4 as a result of such a movement, and therefore hangs from the swivel unit 14 in a projecting manner. Such a situation is illustrated in FIG. 2.

Figure 3:
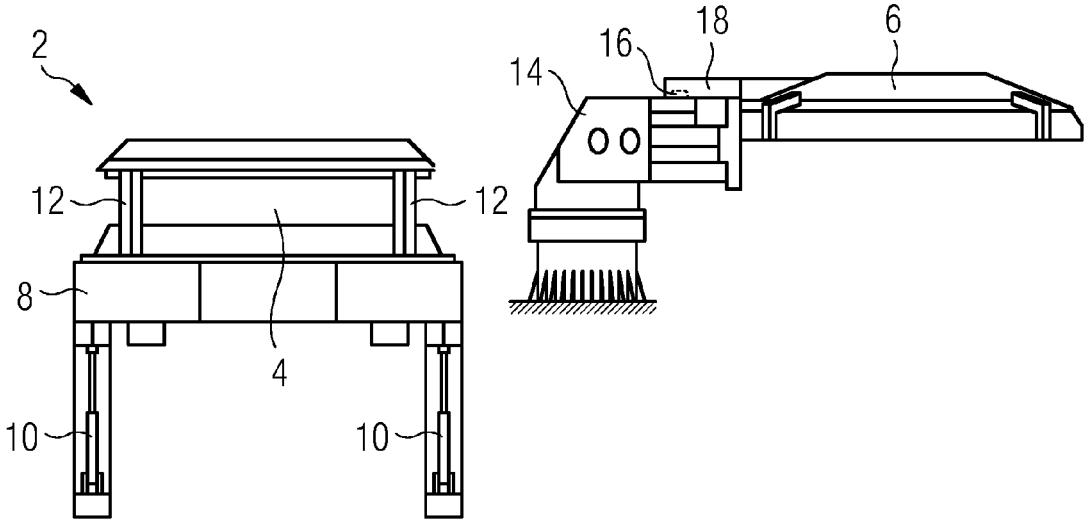
FIG. 3 shows an arc furnace with an open cover.

The cover 6 can then be moved away from the furnace vessel 4 by means of the swivel unit 14, employing a rotational movement about the axis A which extends in a vertical direction, as illustrated in FIG. 3. As a result of such a movement of the cover 6, the furnace vessel 4 is then in the open state and can be charged with scrap, for example. In this situation, the cover 6 is located to the side of the furnace vessel 4.

Figure 2:
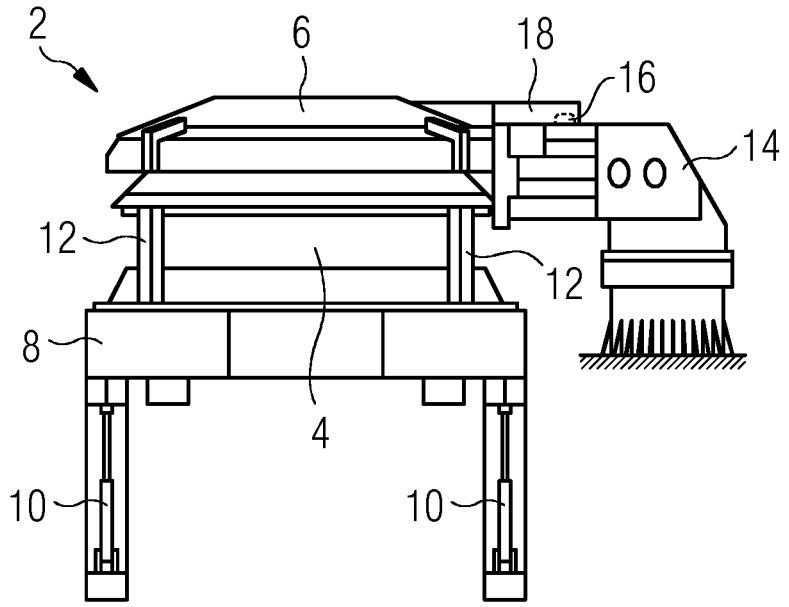
FIG. 2 shows a furnace with a cover, this being fixed to the swivel unit.

After charging the furnace vessel 4 with steel scrap, the cover 6 can then be moved back towards the furnace vessel 4, thereby returning to the situation illustrated in FIG. 2, in which the cover 6 is again arranged above the furnace vessel 4. If the cradle 4 is then moved upwards in a vertical direction by means of the hydraulic cylinders 10, the cover 6 is lifted from the holder 14 of the swivel unit 16 and therefore released from its fixed position in a vertical direction. The cover 6 is then supported on the struts 12 again, as illustrated in FIG. 1.

By virtue of the inventive configuration of the arc furnace 2, it is therefore possible to dispense with a pivot cylinder as is required in the case of an arc furnace according to the prior art. Therefore fewer components are required and the opening process of the furnace vessel 4 is simplified.

Although the invention is illustrated and described in detail with reference to the preferred exemplary embodiment, it is not restricted by the examples disclosed herein, and other variations may be derived therefrom by a person skilled in the art without thereby departing from the scope of the invention.

The invention claimed is:

1. An arc furnace comprising:

a furnace vessel for melting steel, a cover for closing the furnace vessel, the cover including a connection element, a swivel unit by means of which the cover is moved away from the furnace vessel, the swivel unit including a holder, a cradle configured to move in the vertical direction below and above an engagement position to selectively fix and release the cover from the swivel unit, struts arranged on the cradle to move vertically with the cradle, the struts supporting the cover when the cover is operated to close the furnace vessel and disengage from the cover after the cover is releasably fixed to the swivel unit wherein:

a) the furnace vessel is mounted to be movable in a vertical direction relative to the swivel unit, and b) the holder and the connection element engage to fix the cover to the swivel unit when the cradle is moved in a vertical direction below the engagement position, and the holder and the connection element disengage to release the cover from the swivel unit when the cradle is moved in the vertical direction above the engagement position, wherein the furnace vessel is mounted in the cradle.

2. The arc furnace as claimed in claim 1, further comprising hydraulic cylinders at the cradle located and configured for moving the cradle in the vertical direction.

3. The arc furnace as claimed in claim 2, further comprising a plurality of the hydraulic cylinders which are activated separately.

4. The arc furnace as claimed in claim 3, wherein the swivel unit is stationary in the vertical direction.

5. The arc furnace as claimed in claim 2, wherein the swivel unit is stationary in the vertical direction.

6. The arc furnace as claimed in claim 1, wherein the cover is supported to be movable away from the furnace vessel by the swivel unit, employing a rotational movement about an axis which extends in a vertical direction.

7. The arc furnace as claimed in claim 6, wherein the swivel unit is stationary in the vertical direction.

8. The arc furnace as claimed in claim 1, wherein the swivel unit is stationary in the vertical direction.

* * * * *